US007850422B2

(12) United States Patent
Herrmann

(10) Patent No.: US 7,850,422 B2
(45) Date of Patent: Dec. 14, 2010

(54) DEVICE FOR ADJUSTING GUIDE BLADES

(75) Inventor: Hubert Herrmann, Haimhausen (DE)

(73) Assignee: MTU Aero Engines GmbH, Munich (DE)

( * ) Notice: Subject to any disclaimer, the term of this patent is extended or adjusted under 35 U.S.C. 154(b) by 841 days.

(21) Appl. No.: 10/588,139

(22) PCT Filed: Jan. 28, 2005

(86) PCT No.: PCT/DE2005/000130

§ 371 (c)(1),
(2), (4) Date: Jun. 25, 2007

(87) PCT Pub. No.: WO2005/073520

PCT Pub. Date: Aug. 11, 2005

(65) Prior Publication Data

US 2007/0280821 A1 Dec. 6, 2007

(30) Foreign Application Priority Data

Jan. 31, 2004 (DE) ..... 10 2004 004 976

(51) Int. Cl.
*F01D 9/02* (2006.01)

(52) U.S. Cl. ..... 415/161; 415/191; 415/202

(58) Field of Classification Search ..... 415/161, 415/202, 191; 60/802
See application file for complete search history.

(56) References Cited

U.S. PATENT DOCUMENTS 2,823,700 A * 2/1958 Christensen ..... 138/46
2,862,687 A 12/1958 Aguet et al.
3,449,914 A * 6/1969 Brown ..... 405/215
4,578,507 A * 3/1986 Wada et al. ..... 560/104
4,718,819 A * 1/1988 Rogo et al. ..... 415/149.1
5,035,572 A 7/1991 Popp
5,205,712 A 4/1993 Hamilton
6,832,486 B2 * 12/2004 Care et al. ..... 60/802
6,873,085 B2 * 3/2005 Graham et al. ..... 310/266

FOREIGN PATENT DOCUMENTS

DE 39 13 102 5/1990
GB 1 499 531 2/1978

OTHER PUBLICATIONS

International Search Report, PCT International Patent Application No. PCT/DE2005/000130, dated May 19, 2005.
Written Opinion of the International Searching Authority, PCT International Patent Application No. PCT/DE2005/000130, dated May 19, 2005.

* cited by examiner

*Primary Examiner*—Ninh H Nguyen
(74) *Attorney, Agent, or Firm*—Kenyon & Kenyon LLP

(57) ABSTRACT

A device is for adjusting guide blades of a gas turbine. The guide blades are each connected to an adjusting ring via an adjusting lever, so as to be able to swivel, a first end of the, or each, adjusting lever engaging with the adjusting ring, and a second end of the, or each, adjusting lever, opposite to the first end, engaging with an end of a shaft or shank of the respective guide blade. The adjusting ring is assigned a rotor of a torque motor, a stator of the torque motor concentrically surrounding the rotor of the torque motor.

9 Claims, 1 Drawing Sheet

DEVICE FOR ADJUSTING GUIDE BLADES

FIELD OF THE INVENTION

The present invention relates to a device for adjusting guide.

BACKGROUND INFORMATION

Gas turbines, in particular aircraft engines, are made up of a plurality of modules, for example a fan, a combustion chamber, e.g., a plurality of compressors, as well as a plurality of turbines. A plurality of stationary guide blades and a plurality of rotating rotor blades are situated in a turbine, as well as in a compressor of the gas turbine. The guide blades are arranged to be fixed with respect to a housing of the gas turbine. The rotor blades are assigned to at least one rotor and rotate with respect to the stationary guide blades and the stationary housing. If the turbine or the compressor has a plurality of stages, then guide blades and rotor blades are alternately positioned in series in the axial direction or direction of flow; several rotor blades or guide blades, which form so-called guide-blade rings or rotor-blade rings, also being arranged at an axial position, i.e., along the circumference of the rotor or the housing.

The stationary guide blades of a compressor or a turbine may be arranged to be able to move or swivel about an axis. Thus, for example, German Published Patent Application No. 39 13 102 describes a device for adjusting guide blades, where guide blades of a guide-blade ring are connected to an adjusting ring, outside of a housing of the gas turbine, via adjusting levers, so as to be able to swivel, a first end of the, or each, adjusting lever engaging with the adjusting ring, and a second end of the, or each, adjusting lever, opposite to the first end, engaging with an end of a shaft or shank of the respective guide blade. The guide blades are adjusted hydraulically, e.g., by hydraulic pistons.

SUMMARY

According to example embodiments of the present invention, the adjusting ring is assigned a rotor of a torque motor, a stator of the torque motor concentrically surrounding the rotor of the torque motor. The adjusting ring may take the form of a rotor of the torque motor.

The electrical energy needed to operate the torque motor may be provided by a generator of the gas turbine, the generator having a stator and a rotor, and the rotor of the generator taking the form of a freewheeling generator turbine, which, driven by a gas stream, rotates relative to the stator of a generator and thus generates electrical energy from the kinetic energy of the gas stream.

The stator of the torque motor and the stator of the generator may be supported on a common mount fixture, the stator of the generator concentrically surrounding the stator of the torque motor, the two being made out of an electrical sheet-steel laminate. Accordingly, the stator of the torque motor surrounds the rotor of the torque motor, the stator of the generator surrounds the stator of the torque motor and, therefore, the rotor of the torque motor as well, and the rotor of the generator surrounds the stator of the generator and, therefore, the stator and the rotor of the torque motor as well.

Exemplary embodiments of the present invention are explained in more detail below with reference to the appended FIGURE.

DETAILED DESCRIPTION

Figure 1:
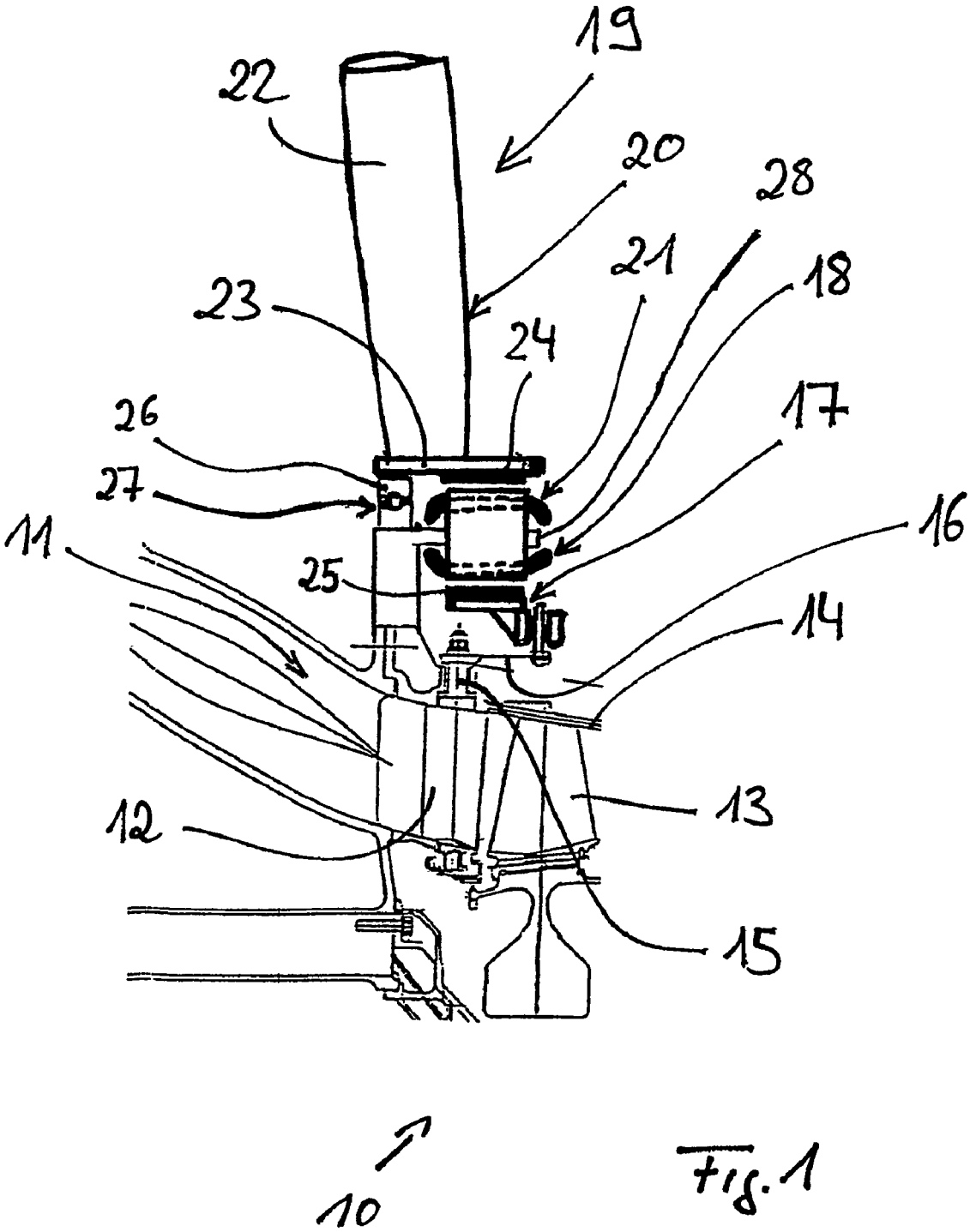
FIG. 1 is a schematic cross-sectional view of a gas turbine of an example embodiment of the present invention, in the region of a high-pressure compressor.

In the following, example embodiments of the present invention are described in more detail with reference to FIG. 1.

FIG. 1 is a schematic cross-section of a high-pressure compressor 10 of a gas turbine of, e.g., an aircraft engine. Thus, FIG. 1 illustrates a flow channel 11 of high-pressure compressor 10, stationary guide blades 12 and rotating rotor blades 13 being positioned one behind the other in flow channel 11, in the axial direction or in the flow direction of the same. Guide blades 12 mounted at an axial position of high-pressure compressor 10 and distributed about its circumference form guide-blade rings, and rotor blades 13 mounted at an axial position form rotor-blade rings. Only one guide-blade ring made up of guide blades 12 and one rotor-blade ring made up of rotor blades 13 are illustrated in FIG. 1. Several such guide-blade rings and rotor-blade rings may be alternately positioned in series in the flow direction of high-pressure compressor 11.

Flow channel 11 of the high-pressure compressor is bounded by a housing 14. At a radially externally end, stationary guide blades 12 have a shaft 15, with the aid of which the same penetrate housing 14. An adjusting lever 16 engages with shaft 15 of each adjustable guide blade 12, adjusting lever 16 also being connected to an adjusting ring 17. All adjusting levers 16 of guide blades 12 of a guide-blade ring are connected to the same adjusting ring 17. Therefore, all guide blades 12 of a guide-blade ring may be adjusted or swiveled in unison by rotating adjusting ring 17.

Adjusting ring 17 is assigned a rotor of a torque motor, adjusting ring 17, e.g., taking the form of a rotor of the torque motor. A stator 18 of the torque motor concentrically surrounds the adjusting ring 17 taking the form of a rotor of the torque motor, e.g., radially from the outside.

The electrical energy required for operating the torque motor is provided by a generator 19 of the gas turbine. Generator 19 of the gas turbine has a rotor 20 and a stator 21, as does the torque motor. Rotor 20 of generator 19 takes the form of a freewheeling generator turbine, which, driven by a gas stream, rotates relative to stator 21 of generator 19 and thus generates electrical energy from the kinetic energy of the gas stream. In this context, rotor 20 of generator 19 may be driven by a gas stream of a fan or fan module of the gas turbine. To this end, generator 19 is positioned downstream from the fan or fan module, a generator module having the generator being detachably connected to the fan module at the downstream end of the fan module. Generator 19, i.e., rotor 20 of generator 19, may be driven by a bypass gas stream of the fan or fan module and accordingly may generate electrical energy from this bypass gas stream.

Rotor 20 of generator 19, taking the form of a freewheeling generator turbine, has a plurality of rotating blades 22, the inner radial ends of blades 22 being connected to an outer bearing ring 26 of a bearing 27 via a platform 23. The inner radial ends of blades 22, i.e., platform 23, are assigned pole pieces 24. As illustrated in FIG. 1, rotor 20 of generator 19, together with pole pieces 24, radially surrounds stator 21 of generator 19 on the outside. Stator 21 includes windings and magnetic circuits, in order to ultimately generate electrical energy from the motion or rotation of rotor 20 of generator 19. At least part of the electrical energy generated in stator 21 of generator 19 is supplied to stator 18 of the torque motor and used there for moving or driving adjusting ring 17 taking the form of a rotor of the torque motor.

As illustrated in FIG. 1, stator 21 of generator 19 and stator 18 of the torque motor are supported on a common mount fixture 28. In this context, stator 21 of generator 19 concentrically surrounds stator 18 of the torque motor and forms, together with it, a unit. Accordingly, stator 18 of the torque motor surrounds the rotor of the torque motor; stator 21 of generator 19 surrounds stator 18 of the torque motor and, therefore, the rotor of the torque motor as well; rotor 20 of generator 19 surrounds stator 21 of generator 19 and, therefore, stator 18 and the rotor of the torque motor as well. The rotor of the torque motor is adjusting ring 17.

Stator 18 of the torque motor includes windings, and adjusting ring 17 is assigned magnetic elements 25. Several such magnetic elements 25 are positioned so as to be distributed over the circumference of adjusting ring 17, the gap between two adjacent magnetic elements 25 being dimensioned such that adjusting lever 16 leading to guide blades 12 may be mounted between the same.

Only one guide-blade ring having adjustable guide blades 12 is illustrated in FIG. 1. The guide blades of a plurality of guide-blade rings may also be adjusted as described above. In this instance, the adjustable guide blades of each guide-blade ring are adjustable via an adjusting ring, each adjusting ring of each guide-blade ring, e.g., being assigned a rotor of a torque motor.

The device of example embodiments of the present invention for adjusting guide blades may eliminate the hydraulic pistons required by conventional device for moving the adjusting ring. With the aid of example embodiments of the present invention, it is possible to use the electrical energy generated by a generator to electrically adjust the guide blades, while adding only a little weight to the gas turbine. The device of example embodiments of the present invention may allow the guide blades to be adjusted in a particularly rapid manner, since conventional electromotive drives having gears are dispensed with.

What is claimed is:

1. A device for adjusting guide blades of a gas turbine, comprising:

an adjustment ring;

an adjustment lever, each guide blades connected to the adjustment ring via the adjustment lever, so as to be swivelable, a first end of the adjustment lever engaged with the adjustment ring, a second end of the adjustment lever, opposite to the first end, engaged with an end of a shaft of the guide blade;

a generator including a stator and a rotor, wherein the adjustment ring is assigned a rotor of a torque motor, a stator of the torque motor concentrically surrounding the rotor of the torque motor, the rotor of the generator concentrically surrounding the stator of the torque motor.

2. The device according to claim 1, wherein electrical energy required for operation of the torque motor is provided by the generator of the gas turbine, the rotor of the generator arranged as a freewheeling generator turbine, which, driven by a gas stream, rotates relative to the stator of the generator to generate electrical energy from kinetic energy of the gas stream.

3. The device according to claim 1, wherein the rotor of the torque motor includes a plurality of magnetic elements distributed over a circumference.

4. A device for adjusting guide blades of a gas turbine, comprising:

an adjustment ring;

an adjustment lever, each guide blades connected to the adjustment ring via the adjustment lever, so as to be swivelable, a first end of the adjustment lever engaged with the adjustment ring, a second end of the adjustment lever, opposite to the first end, engaged with an end of a shaft of the guide blade, wherein the adjustment ring is arranged as a rotor of the torque motor, a stator of the torque motor concentrically surrounding the adjustment ring.

5. A device for adjusting guide blades of a gas turbine, comprising:

an adjustment ring;

an adjustment lever, each guide blades connected to the adjustment ring via the adjustment lever, so as to be swivelable, a first end of the adjustment lever engaged with the adjustment ring, a second end of the adjustment lever, opposite to the first end, engaged with an end of a shaft of the guide blade, wherein the adjustment ring is assigned a rotor of a torque motor, a stator of the torque motor concentrically surrounding the rotor of the torque motor, wherein electrical energy required for operation of the torque motor is provided by a generator of the gas turbine, the generator including a stator and a rotor, the rotor of the generator arranged as a freewheeling generator turbine, which, driven by a gas stream, rotates relative to the stator of the generator to generate electrical energy from kinetic energy of the gas stream, wherein the generator is arranged downstream from a fan module such that the rotor of the generator is driven by a gas stream of the fan module.

6. The device according to claim 5, wherein the generator is integrated into a generator module, the generator module connected to the fan module at a downstream end, the generator adapted to generate electrical energy from a bypass gas steam of the fan module.

7. A device for adjusting guide blades of a gas turbine, comprising:

an adjustment ring;

an adjustment lever, each guide blades connected to the adjustment ring via the adjustment lever, so as to be swivelable, a first end of the adjustment lever engaged with the adjustment ring, a second end of the adjustment lever, opposite to the first end, engaged with an end of a shaft of the guide blade, wherein the adjustment ring is assigned a rotor of a torque motor, a stator of the torque motor concentrically surrounding the rotor of the torque motor, wherein electrical energy required for operation of the torque motor is provided by a generator of the gas turbine, the generator including a stator and a rotor, the rotor of the generator arranged as a freewheeling generator turbine, which, driven by a gas stream, rotates relative to the stator of the generator to generate electrical energy from kinetic energy of the gas stream, wherein the rotor of the generator includes a plurality of rotating blades and pole pieces assigned to the blades, the pole pieces being assigned to inner radial ends of the rotating blades of the rotor of the generator, the rotor of the generator radially surrounding the stator of the generator from an outside.

8. A device for adjusting guide blades of a gas turbine, comprising:

an adjustment ring;

an adjustment lever, each guide blades connected to the adjustment ring via the adjustment lever, so as to be swivelable, a first end of the adjustment lever engaged with the adjustment ring, a second end of the adjustment lever, opposite to the first end, engaged with an end of a shaft of the guide blade, wherein the adjustment ring is assigned a rotor of a torque motor, a stator of the torque motor concentrically surrounding the rotor of the torque motor, wherein electrical energy required for operation of the torque motor is provided by a generator of the gas turbine, the generator including a stator and a rotor, the rotor of the generator arranged as a freewheeling generator turbine, which, driven by a gas stream, rotates relative to the stator of the generator to generate electrical energy from kinetic energy of the gas stream, wherein the stator of the torque motor and the stator of the generator are supported on a common mount fixture, the stator of the generator concentrically surrounding the stator of the torque motor.

9. A device for adjusting guide blades of a gas turbine, comprising:

an adjustment ring;

an adjustment lever, each guide blades connected to the adjustment ring via the adjustment lever, so as to be swivelable, a first end of the adjustment lever engaged with the adjustment ring, a second end of the adjustment lever, opposite to the first end, engaged with an end of a shaft of the guide blade, wherein the adjustment ring is assigned a rotor of a torque motor, a stator of the torque motor concentrically surrounding the rotor of the torque motor, wherein the rotor of the torque motor includes a plurality of magnetic elements distributed over a circumference, wherein a gap between the magnetic elements is dimensioned so that an adjustment lever leading to an adjustable guide blade is mountable between two adjacent magnetic elements.

* * * * *